US005913738A

United States Patent [19]

Carlucci

[11] Patent Number: 5,913,738

[45] Date of Patent: Jun. 22, 1999

[54] REPEATABLE AND ACCURATE GOLF PUTTING APPARATUS AND METHOD

[76] Inventor: Steven Carlucci, 85 N. Chatsworth Ave., Larchmont, N.Y. 10538

[21] Appl. No.: 08/908,850

[22] Filed: Aug. 8, 1997

[51] Int. Cl.[6] ..... A63B 53/00

[52] U.S. Cl. ..... 473/409; 473/131; 473/300

[58] Field of Search ..... 473/294, 300, 473/304, 203, 204, 293, 409, 212, 276, 277, 319, 313, 314, 131

[56] References Cited

U.S. PATENT DOCUMENTS

| | | | |
|---|---|---|---|
| 792,631 | 6/1905 | Taylor | 473/293 |
| 1,012,299 | 12/1911 | True | 473/300 |
| 1,655,092 | 1/1928 | Davis | 473/212 |
| 2,826,417 | 3/1958 | Marcoccio | 473/293 |
| 3,672,682 | 6/1972 | Yanagidaira | 473/276 |
| 3,679,207 | 7/1972 | Florian | 473/293 |
| 4,067,573 | 1/1978 | Key | 473/300 |
| 4,132,579 | 1/1979 | Vanauken | 473/319 |
| 4,163,554 | 8/1979 | Barnhardt | 473/293 |
| 4,426,083 | 1/1984 | Dishner | 473/294 |
| 5,096,199 | 3/1992 | Wyatt | 473/212 |
| 5,188,361 | 2/1993 | Coome | 473/294 |
| 5,452,891 | 9/1995 | Thomas | 473/300 |
| 5,454,564 | 10/1995 | Kronogard | 473/293 |
| 5,554,078 | 9/1996 | Hannon | 473/292 |
| 5,616,089 | 4/1997 | Miller | 473/409 |

*Primary Examiner*—Sebastiano Passaniti
*Attorney, Agent, or Firm*—Kenyon & Kenyon

[57] ABSTRACT

Apparatus and method for repeatably and accurately performing a putting stroke such that wrist and elbow movement is largely eliminated. A putting club of a length between approximately 42 and 44 inches and having cylindrical grip is gripped such that the forearms of the player are approximately parallel to the putting surface, thereby preventing the player's wrists and elbows from breaking during a putting stroke. By forcing the player to use upper body muscles to propel the putter, wrist movements caused, for example, by nervousness, can be avoided.

6 Claims, 6 Drawing Sheets

REPEATABLE AND ACCURATE GOLF PUTTING APPARATUS AND METHOD

BACKGROUND OF THE INVENTION

1. Field of the Invention

The present invention is directed to a device for use in playing golf or golf-related activities. More specifically, the present invention is directed to a putter which provides improved putting control.

2. Description of the Prior Art

Those who play the game of golf are aware of the importance of the putting aspect of the game in achieving good scores. For example, in a single round of golf in which a player has a stroke total of 90, the player's stroke total may consist of more than 30 putts. Thus, the putting aspect of the game can account for a third (or more) of the strokes taken by a player during any particular round. It has always been desirable to develop putting devices and/or methods which improve the putting accuracy, and therefore lower the total number of putting strokes.

The significance of good putting is reflected in the large number of putting clubs commercially available and sold each year. Players are typically looking for a putting club that will increase their putting "touch"—that is comfortable to swing and will allow them to strike the golf ball accurately and consistently. The great majority of these putting clubs can be classified as "traditional" putters. The traditional putter includes a shaft that is generally 33 to 35 inches in length, with a putting head at one end of the shaft and a grip at the other end of the shaft. The putting head can be shaped in various configurations, but will typically have a flat face for striking a golf ball. The grip is generally 12 inches long and formed from a rubber-type material (although other materials could be used), and fits over the end of the shaft. In prior art putters, the grip has a particular shape that is designed so that the player will hold the golf club in the conventional manner (described below). FIG. 1 is a cross-sectional view of a prior art putter gripper, wherein the grip is shaped such that the front face of the grip (the portion that faces away from the player when the putter is swung) is flattened, allowing the player to place his or her thumbs in a downwardly-pointing direction, according to the conventional putting grip (described below).

FIG. 2 shows a prior art putter as held by a player using a conventional putting grip. As seen in FIG. 2, the traditional putter 1, having a shaft 8 only 33 to 35 inches in length l, only extends as far as the waist area W of the player P. Therefore, the player P must bend over somewhat to swing the prior art putter 1 to contact the golf ball 2 with putter head 4. Grip 6 extends along the top of putter shaft 8, and extends approximately 12 inches downwardly from the end of the putter shaft 8. The grip 6 has a flattened front face 10 (see FIG. 1).

In the prior art method, the player P holds the prior art putter 1 by placing the left hand $H_L$ on the top portion of the grip 6 and the right hand $H_R$ just below the left hand $H_L$ on the grip 6. This configuration is for players who are considered "right handed." Left handed players would have exactly the opposite configuration, and as such the "left handed" configuration need not be separately described. The thumb of the left hand $H_L$ is placed such that it rests on the flatted front face 10 of the grip 6 and is pointing downward. Likewise, the thumb of the right hand $H_R$ is placed such that it rests on the flattened front face 10 of grip 6, just below the left thumb. In this configuration, the player may P swing the prior art putter 1 by bringing the putter backwards toward the right shoulder ("backswing" B) and then accelerating the putter forward toward the left shoulder ("downswing" D) to strike the golf ball 2 lying, for example, on a putting surface S.

On problem with the prior art putting method described above is that the position of the elbows E and wrists R are such that they are prone to involuntary movement during putting, i.e., they can "break" during putting.

The prior art putting method shown in FIG. 2 does not prevent such involuntary movements in the wrists R and elbows E, and therefore can cause inaccurate putting.

Recently, a second type of putter has been offered as an alternative to the prior art putter described above. An "extended length putter" 1' uses a putting head similar to the prior art putter described above, but uses an extra long shaft 8 that can be from 48 to 50 inches in length l', and uses two hand grips 6', 6" spaced apart from each other on the shaft 8'. The upper hand grip 6" has a generally-circular cross-section to match that of the shaft. The lower hand grip 6' is shaped similarly to the traditional putter in that it also has a flat front face 10' to position the thumb in a downwardly-pointing configuration according to the prior art putting hand grip described above.

FIG. 3 depicts a typical extended length putter 1' as used by a player P. As shown in FIG. 3, the 48 to 50 inch length l' of the extended length putter 1' places the end of the putter generally near the player's sternum T, allowing the player P to stand more erect while putting the golf ball 2. This position may be particularly helpful for people susceptible to back injuries. The left hand $H_L$ of the player P is placed on the upper grip 6" in an inwardly-facing palm position, such that the thumb opposes the fingers to form the grip.

Upper grip 6" is shaped in a generally circular cross-sectional manner. The right hand $H_R$ of the player P is placed on the lower grip 6' in a manner similar to the right hand grip for the prior art putter described above, i.e., with the thumb pointing downward. The lower grip 6' has a flattened front face 101 to allow the player P to easily position the thumb in the conventional grip. As with the prior art putter of FIG. 1, when using the extended length putter 1', the player brings the putter backward toward the right shoulder, and then accelerates the putter forward toward the left shoulder to strike the golf ball 2 with the desired force.

As with the prior art method of FIG. 2, the prior art putting method shown in FIG. 3 does not prevent involuntary movements in the wrists R and elbows E, and therefore can cause inaccurate putting. This is because the position of the elbows E and wrists R are such that they are prone to involuntary movement during putting, i.e., they can "break" during putting.

The goal of players in perfecting a putting stroke is to be able to perfectly gauge the amount of force imparted to the golf ball upon impact with the putter head and the direction at which the golf ball will be accelerated after being struck. If the player can control the putting stroke in this fashion, then the putting aspect of the game is reduced to "reading the green," i.e., determining where to aim in order for the golf ball to roll into the hole. It has been found by golf teachers and professionals that the most accurate and consistent way to perform a putting stroke is to swing the putting club by keeping the wrists and elbows locked in the same position throughout the swing, and moving the putter by rotating the shoulders. This "pendulum" swing uses the large body muscles in the upper back, and results in a swing that is smooth, controllable and repeatable. Players who are considered to be among the best putters generally use the pendulum swing.

The problem with both the traditional putter 1 and, to a certain degree, the extended length putter 1'—and the swing techniques used for either—is that players tend to move their wrists and/or elbows during the backswing and/or downswing portions of the swing (also know as "breaking the wrists" or "breaking the elbows"). By breaking the wrists or elbows, the plane of the swing and/or the face of the putter head can become skewed, resulting in a putt that is off-line and of a varying speed from what was intended by the player. Players are often susceptible to this condition at undesirous times, for example, for important putts during a tournament or where a prize is at stake. The situational stress associated with these critical shots may cause muscle tension in the smaller muscle groups of the arms/wrists, causing unwanted wrist or elbow motion.

It would therefore be advantageous to develop a putting club and a putting method that are able to force the player to use the pendulum swing every time, even under stressful conditions.

SUMMARY OF THE INVENTION

The present invention provides an apparatus and method for performing a putting stroke that forces the player to use the pendulum swing method. The apparatus of the present invention includes a putting club having a shaft of between approximately 42 to 44 inches in length, such that the putter extends to the mid-torso area of the player. The shaft uses a grip that is completely circular in cross-section, with no flat front face.

The configuration of the putter according to the present invention forces the player to use the method of the present invention. In one embodiment of that method, the player grasps the putter with a "palms together" grip, such that the player's forearms are approximately parallel with the ground. In a second embodiment of the method of the present invention, the player grasps the putter with a "palms in" grip such that the player's forearms are again approximately parallel to the ground. The shaft length and grip used in the putter according to the present invention allows the player to easily place the hands in these grip and arm positions.

The player may now perform a putting stroke by rotating the upper body in a pendulum motion. For example, the upper body is rotated to cause the putter to backswing away from the golf ball, and then rotated to cause the putter to downswing to strike the ball with the desired force. With the grips described above applied to the putter, it becomes difficult for a player to move the wrists and elbows while having the hands attached to the putter. Without the capability to break the wrists or elbows during putting, the player is forced to use the muscles of the upper body to propel the putter, thereby avoiding the problems that can contribute to inaccurate putting strokes.

DETAILED DESCRIPTION OF THE DRAWINGS

Figure 1:
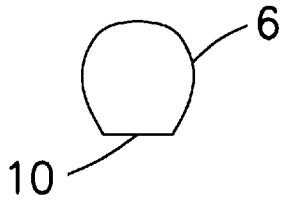
Fig. 1 PRIOR ART
FIG. 1 is a cross-sectional view of a prior art putter grip.
Figure 2:
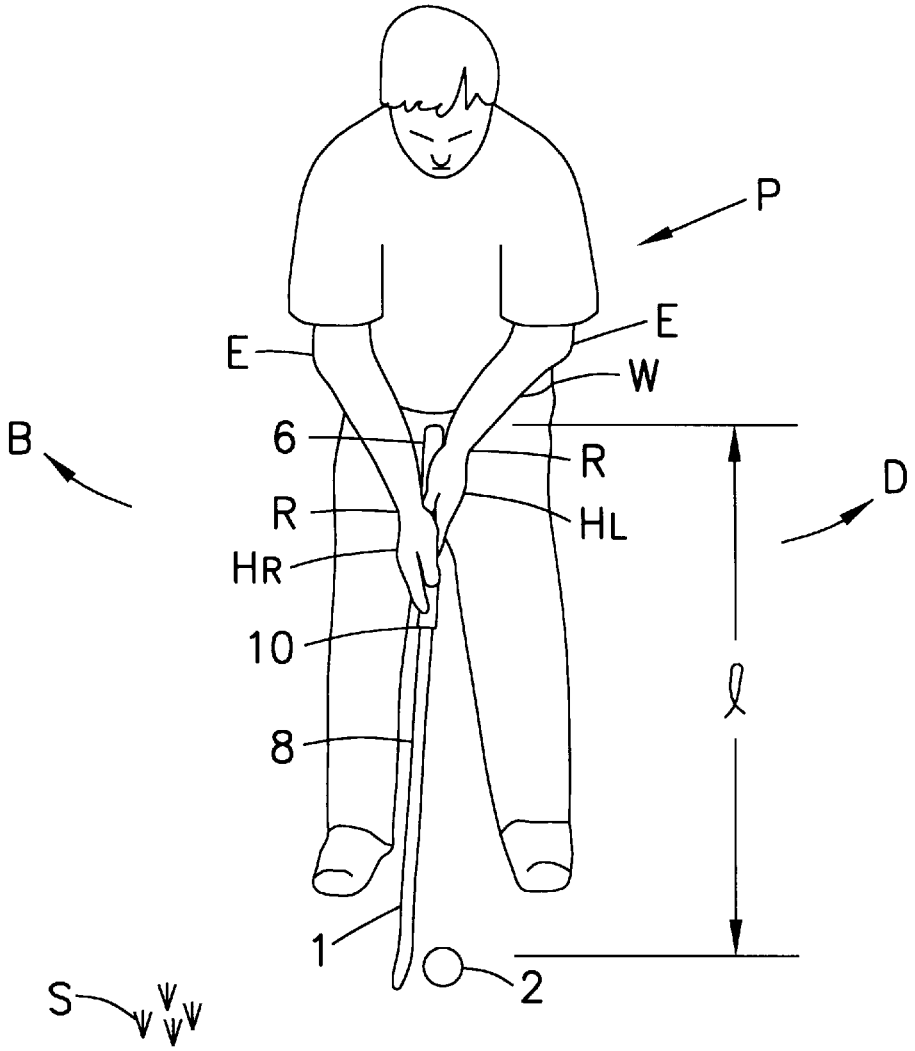
Fig. 2 PRIOR ART
FIG. 2 shows a prior art conventional putter as held by a player during use.
Figure 3:
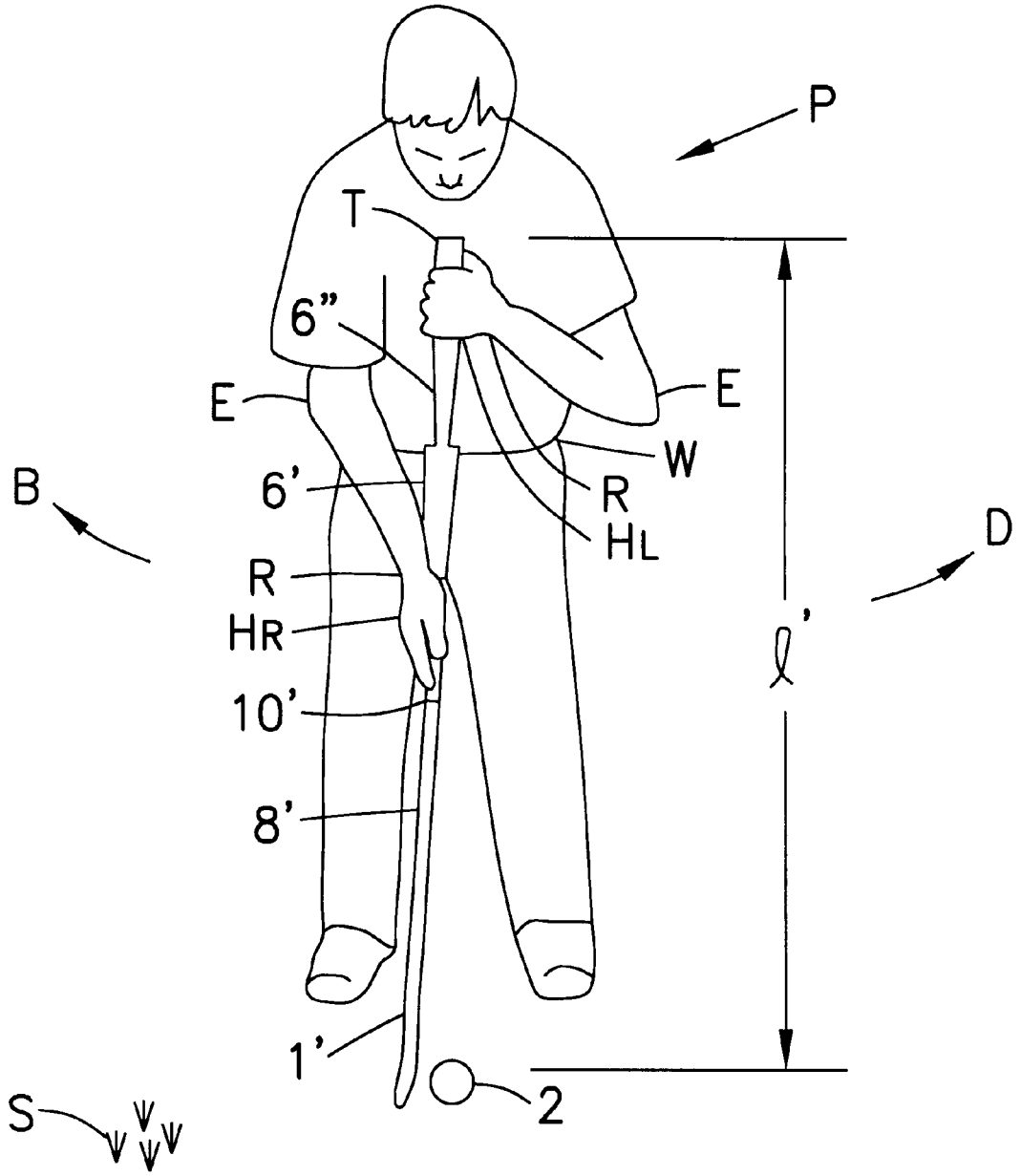
Fig. 3 PRIOR ART
FIG. 3 shows a prior art extended-length putter as held by a player during use.
Figure 4:
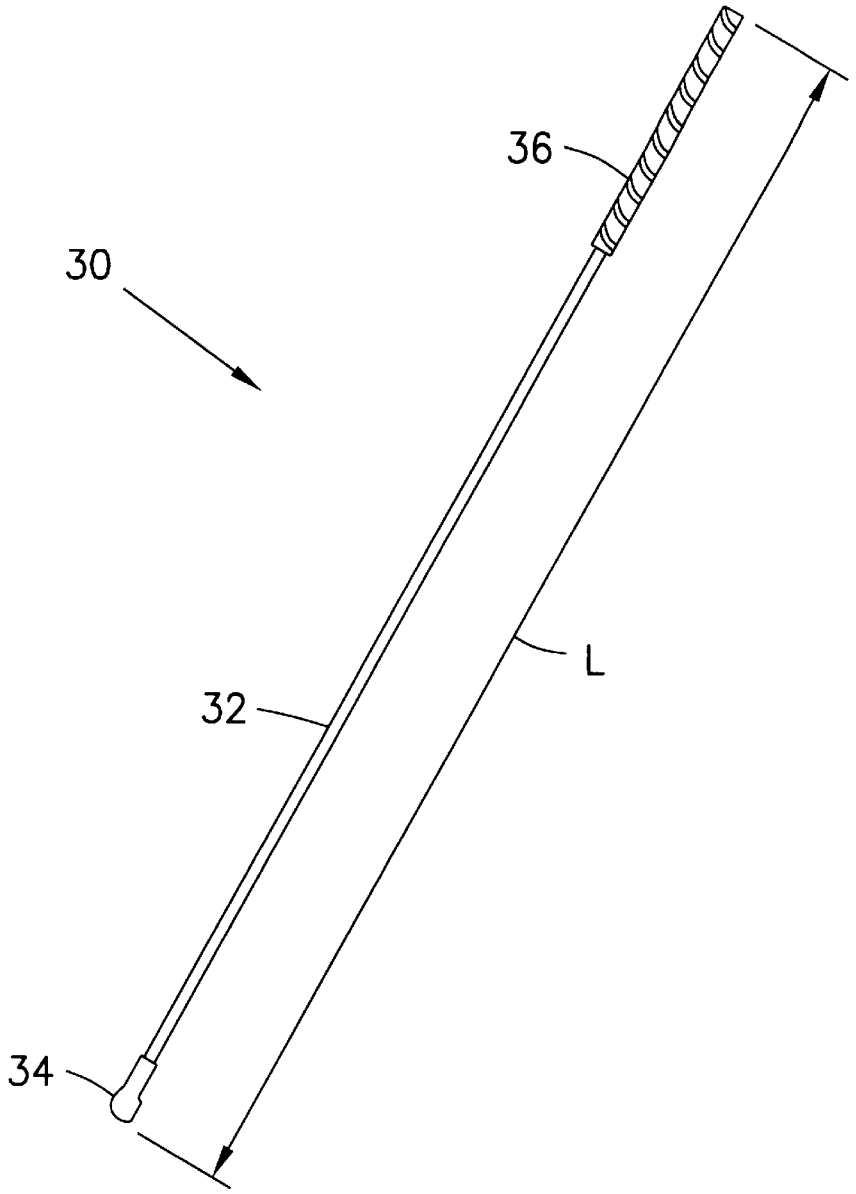
FIG. 4 shows a putting club apparatus according to the present invention.
Figure 7:
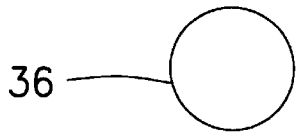
FIG. 7 is a cross-sectional view of the grip of the putting club of the present invention.

The present invention will now be described with reference to FIGS. 4–7 which illustrate several specific embodiments of the present invention. FIG. 4 depicts a putting club 30 according to the present invention. Putting club 30 includes a shaft 32, putting head 34, and grip 36. Putting head 34 is affixed by conventional methods to an end of shaft 32. Grip 36 is affixed to the opposite end of shaft 32, typically by sliding the grip over the end of shaft 32. This is possible, for example, where the grip 36 is of a hollowed-out, cylindrical shape (described below).

Shaft 32 will typically be between approximately 42 to 44 inches in length L, such that the top end of the shaft (when in putting position) reaches the mid-torso region M of the player. The shaft may be constructed of materials generally used in putter club construction, for example, various metals or graphite. As players may vary in size, the length of the shaft 32 may also vary, within the above-described range. The length L of the shaft 32 is selected in order to force a player P to grip the putter 30 with his or her forearms F approximately parallel to the ground or putting surface S when the ball 2 is addressed (i.e., prior to swinging of the putting club 30, when the putter 30 is approximately perpendicular to the putting surface S), in a manner according to the present invention, as will be described in further detail below. Grip 36 is shaped such that the grip 36 has a substantially circular cross-section (FIG. 7), also allowing a player to grip the putter 30 in accordance with the method of the present invention. Grip 36 can be hollowed-out in a manner similar to conventional grips such that grip 36 can be fit over the end of shaft 32. The grip 36 may be made of rubber or other suitable substance as is normally used for putter grips.

Figure 5A:
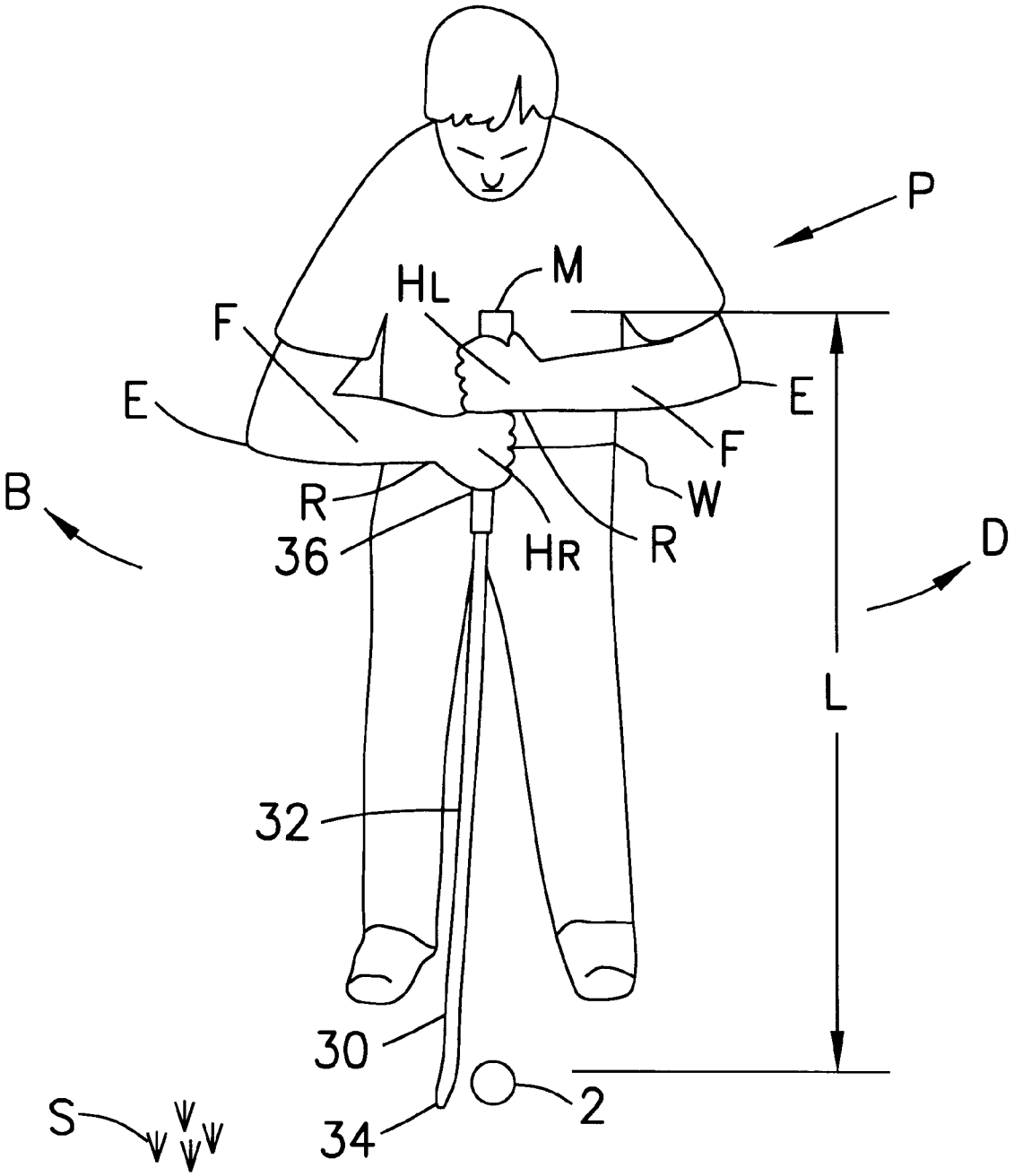
FIG. 5*a* shows a putting club according to the present invention as held by a player at rest in a first embodiment of a method according to the present invention.
Figure 5B:
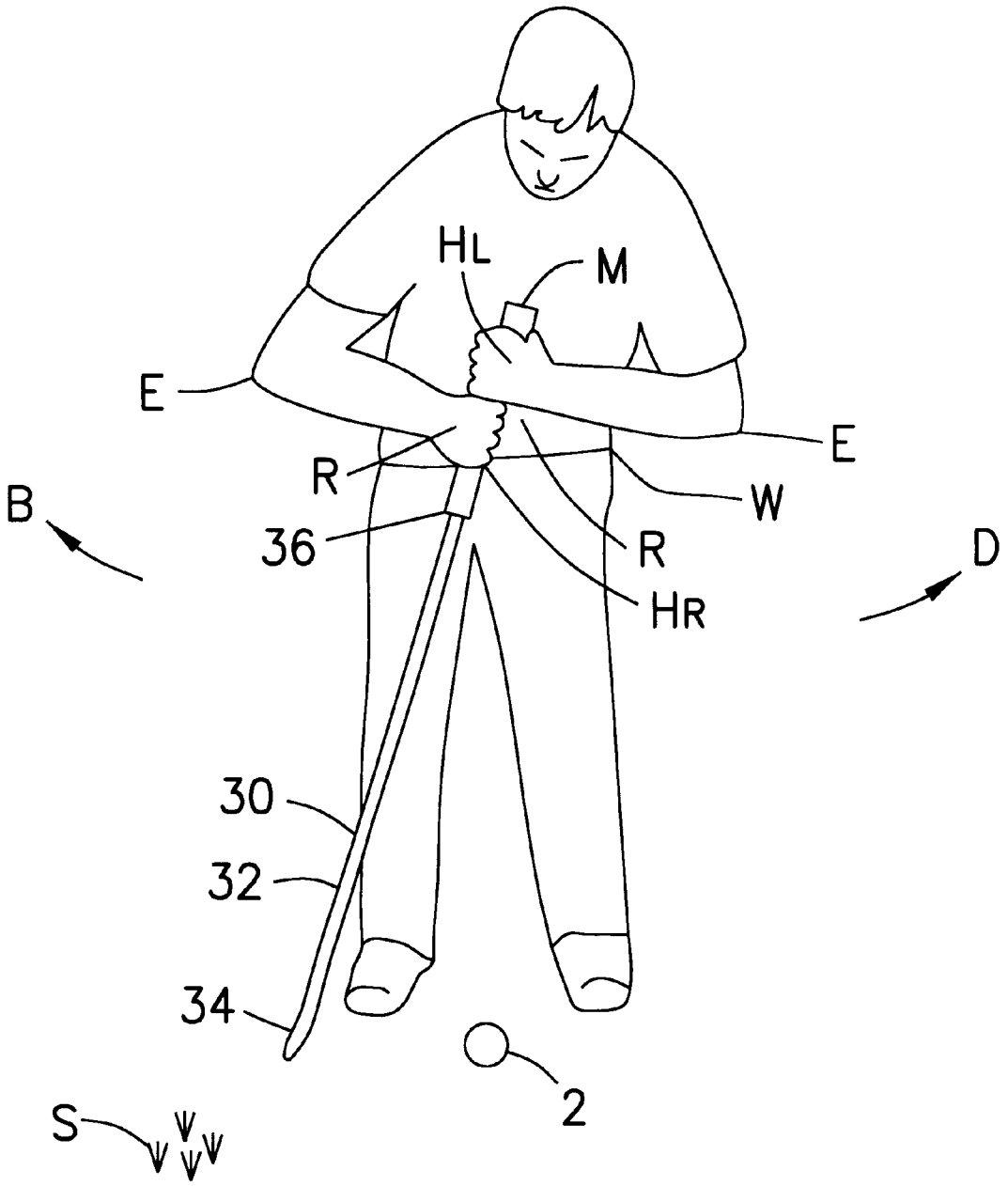
FIG. 5*b* shows a putting club according to the present invention at the top of a backswing using the first embodiment of the method according to the present invention.

By using, for example, putting club 30, a player P may practice the method of the present invention. In a first embodiment of the method of the present invention, which can be described as a "palms in" grip, a player P applies his or her hands to the putter 30 as shown in FIGS. 5*a* and 5*b*. The left hand $H_L$ is placed at the top of the grip 36 such that the palm of the player's left hand $H_L$ faces toward the player and the fingers surround the grip 36. The player's thumb opposes the fingers to grasp the grip 36 firmly. Due to the length L of the shaft 32 of putter 30, according to the present invention, the player's left elbow E is forced to be raised. The raised left elbow E causes the left forearm F to be approximately parallel to the ground S, thereby causing the putter 30 to be at approximately a 90 degree angle to the left forearm F when the ball 2 is addressed. Thus, using this grip, the left wrist R can be kept in a natural 90 degree position relative to the putter 30. In a manner similar to the left hand $H_L$, the right hand HR is placed below the left hand $H_L$ on the grip 36, such that the palm of the right hand $H_R$ faces toward the player P, the fingers surround the grip 36, and the thumb opposes the fingers to firmly grasp the grip 36. This grip technique forces the right elbow E to be raised, thereby forcing the right forearm F to be approximately parallel to the ground S. The position of the right forearm causes the right wrist R to be at an approximately 90 degree position relative to the putter 30. The circular cross-section of the grip 36 allows this grip position to be comfortable, as there are no flat areas on the grip 36 pressing against the palm or the insides of the fingers. It should be noted that the technique of the first and second exemplary embodiment would not be possible using the traditional putter or the extended length putter, since the forearm position when the end of the aforementioned putters is gripped would not be approximately parallel to the ground. In a traditional prior art putter, the length l is not sufficiently long to allow gripping of the grip 6 with both hands $H_L$, $H_R$ with the forearms F in a position parallel to the ground S. In a prior art extended length putter 1', the shape of the two grips 6' and 6" is not amenable to comfortable gripping by both hands $H_L$, $H_R$ with the forearms F in a position parallel to the ground S. In addition, in the prior art extended length putter 1', the additional length interferes with natural use of the putting methods of the present invention, and therefore the prior art extended length putter 1' may not be used with the method of the present invention.

Figure 6:
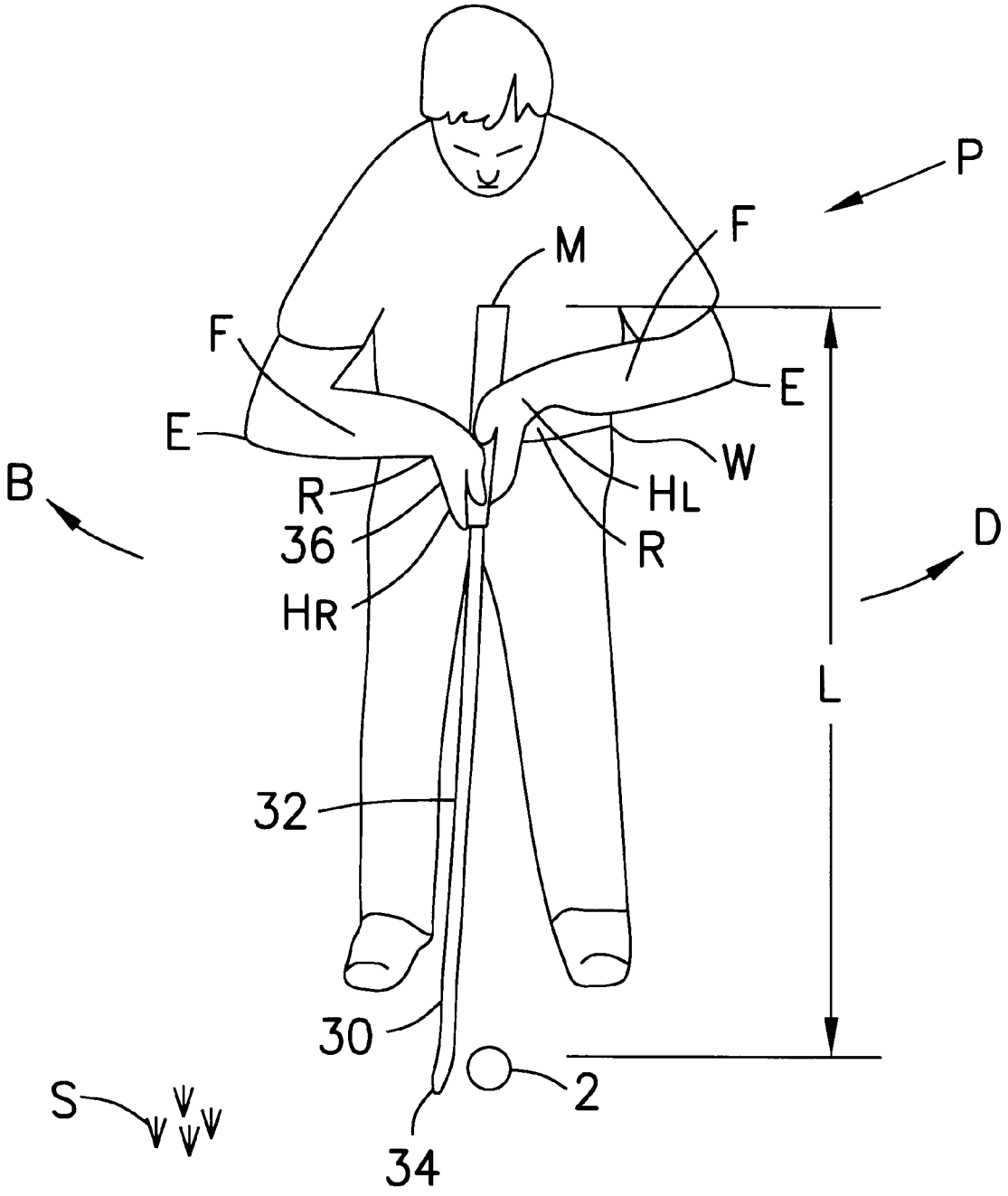
FIG. 6 shows a putting club according to the present invention as held by a player at rest in a second embodiment of the method according to the present invention.

FIG. 6 depicts a second exemplary embodiment of the method according to the present invention wherein the player uses a "palms together" grip technique. As shown in FIG. 6, each of the right and left hands $H_R$, $H_L$ are placed on the grip 36 of putter 30 such that the fingers of each hand are pressed together and downwardly pointed, where the grip is disposed vertically between the hands. The forearms F of each arm are positioned at an approximately parallel position relative to the ground S, causing an approximately 90 degree angle between each wrist R and the corresponding forearm F. As with the first exemplary embodiment, the "palms together" technique locks the wrists in position. In this case, the opposing forearms F exert opposing forces to keep the wrist R positions locked. The mechanics of the swing when using the "palms together" technique is similar to that of the first exemplary embodiment (as depicted in FIGS. 5*a* and 5*b*).

The effectiveness of the aforementioned grip technique is illustrated in FIGS. 5*a* and 5*b*. FIG. 5*b* shows the player after performing a backswing B using a "palms in" locked wrist grip described above. Because of the gripping technique, in order for the player P to swing back the putter 30, the player P must rotate the upper body. The 90 degree position of the forearms F to the shaft 32 is not only a natural and comfortable position for the wrists R and elbows E, but the opposing forearms F cause the wrists R and elbows E to be locked in position, discouraging unwanted wrist R and elbow E movement.

Because the grip physically discourages the breaking of the wrists R and elbows E during the putting stroke, there is less of a requirement to concentrate to prevent wrist R or elbow E movement, as is necessary for the prior art putting strokes. Thus, in those situations where situational stress may make it difficult to provide the necessary concentration to keep steady wrist R and elbow E position, the method of the present invention advantageously prevents such movement.

In the preceding specification, the invention has been described with reference to specific exemplary embodiments thereof. It will, however, be evident that various modifications and changes may be made thereunto without departing from the broader spirit and scope of the invention as set forth in the claims that follow. The specification and drawings are accordingly to be regarded in an illustrative rather than restrictive sense.

What is claimed is:

1. A method for putting a golf ball, comprising the steps of:

gripping a putter such that both forearms of a player using the putter are parallel to a putting surface;

taking a backswing by rotating an upper body of the player without wrist and elbow movement;

taking a downswing by rotating the upper body of the player without wrist and elbow movement;

striking the golf ball.

2. The method for putting of claim 1, wherein the gripping step includes placing each hand of the player on a grip of the putter so that palms of the hands face each other.

3. The method for putting of claim 1, wherein each wrist of the player is positioned at approximately 90 degrees to each forearm of the player.

4. The method for putting of claim 1, wherein the gripping step includes placing each hand of the player on a grip of the putter so that the palms face the player.

5. The method for putting of claim 1, wherein the player grips the shaft at a location below approximately 42 to 44 inches from a head of the putter.

6. A method for putting a golf ball, comprising the steps of:

gripping a putter such that both forearms of a player using the putter are approximately parallel to a putting surface and placing each hand of the player on a grip of the putter so that the palms face the player;

taking a backswing by rotating an upper body of the player without wrist and elbow movement;

taking a downswing by rotating the upper body of the player without wrist and elbow movement;

striking the golf ball.

* * * * *